US008146722B1

(12) United States Patent
Moreno et al.

(10) Patent No.: US 8,146,722 B1
(45) Date of Patent: Apr. 3, 2012

(54) TRAVEL ASSISTING LUGGAGE SYSTEM

(76) Inventors: Jesse Moreno, Surprise, AZ (US); Manuel Amaya, Surprise, AZ (US)

( * ) Notice: Subject to any disclaimer, the term of this patent is extended or adjusted under 35 U.S.C. 154(b) by 422 days.

(21) Appl. No.: 12/549,042

(22) Filed: Aug. 27, 2009

(51) Int. Cl.
*A45C 5/14* (2006.01)

(52) U.S. Cl. ..... 190/18 A; 190/8; 190/18 R; 190/115; 190/9; 206/576

(58) Field of Classification Search ..... 190/3–12 A, 190/18 R, 18 A; 206/576
See application file for complete search history.

(56) References Cited

U.S. PATENT DOCUMENTS

| | | | | |
|---|---|---|---|---|
| 1,924,824 | A * | 8/1933 | Yeager | 126/306 |
| 3,557,916 | A * | 1/1971 | Stowell | 190/11 |
| 4,856,627 | A * | 8/1989 | Polatov | 190/11 |
| 5,100,198 | A * | 3/1992 | Baltzell | 312/235.2 |
| 5,374,073 | A | 12/1994 | Hung-Hsin | |
| 5,409,152 | A * | 4/1995 | Trevino | 224/576 |
| 5,941,352 | A * | 8/1999 | Lee | 190/11 |
| 5,957,349 | A | 9/1999 | Krulik | |
| 6,105,508 | A | 8/2000 | Ryburg | |
| D459,883 | S | 7/2002 | Worrell et al. | |
| 6,471,019 | B1 | 10/2002 | Miller | |
| 6,644,447 | B2 * | 11/2003 | Pohl | 190/8 |
| 6,769,588 | B2 * | 8/2004 | Zheng | 224/576 |
| 6,932,427 | B2 * | 8/2005 | Tamura | 297/217.1 |
| 7,097,017 | B1 | 8/2006 | LaCrosse et al. | |
| 7,114,602 | B2 | 10/2006 | Chen | |
| 7,213,692 | B2 | 5/2007 | Wang et al. | |
| 7,422,476 | B2 * | 9/2008 | Marmaropoulos et al. | 439/577 |
| 7,607,630 | B2 * | 10/2009 | Jung et al. | 248/440.1 |
| 7,793,970 | B2 * | 9/2010 | Fegler et al. | 280/643 |
| 7,987,955 | B2 * | 8/2011 | Puchalski | 190/18 A |
| 2005/0098402 | A1 * | 5/2005 | Cohen | 190/12 A |
| 2011/0056788 | A1 * | 3/2011 | Jackson | 190/2 |

* cited by examiner

*Primary Examiner* — Tri Mai

(57) ABSTRACT

Disclosed is a travel assisting luggage system to carry articles and otherwise assist a person while traveling with the luggage system. The luggage system may include a frame, a container connected around the frame, an axle connected to the frame and to wheels, an entertainment center attached to a container side, a seat system connected to the frame, where the seat system may include a seat extension, a backrest, a support feet, a support feet housing, and a support plate. The luggage system additionally may include an organization system positioned within the container interior.

12 Claims, 6 Drawing Sheets

TRAVEL ASSISTING LUGGAGE SYSTEM

BACKGROUND

1. Field

The information disclosed relates to a luggage system having a pullout tray, extendable bottom support systems, an entertainment center, and other items to assist a person while traveling with the luggage system.

2. Background Information

Travel in the United States involves a multi-billion dollar industry where travel luggage makes up a significant percentage of the revenues generated in the industry. While there are many cases and containers that hold a traveler's articles during transit, wheeled suitcases, carry-ons, duffels, and other rolling luggage are the most popular with travelers since they allow travelers to pack without having to use their backs to carry the weight of their packed articles. Moreover, as many airlines have tightened their luggage requirements and security measures have become increasingly strict, rolling luggage meets the need for practical and sturdy luggage that meet these requirements and measures.

Often, weary airline travelers will use their luggage as a seat, particularly where there are no seats available in an airport terminal. In particular, the September 11 terrorists' attacks resulted in increased security at airports causing travelers to spend a substantial amount of time in long lines where airport seats are not provided. In response to this, several inventors have devised luggage with seats. However, these configurations fail to offer sufficient stability and seating space to meet the needs of modern, larger-sized travelers. In addition, such luggage lacks additional features that provide added convenience and comfort for travelers. What is needed is a luggage system to address these and other issues.

SUMMARY

Disclosed is a travel assisting luggage system to carry articles and otherwise assist a person while traveling with the luggage system. The luggage system may include a frame, a container connected around the frame, an axle connected to the frame and to wheels, an entertainment center attached to a container side, a seat system connected to the frame, where the seat system may include a seat extension, a backrest, a support feet, a support feet housing, and a support plate. The luggage system additionally may include an organization system positioned within the container interior.

DETAILED DESCRIPTION

Figure 1:
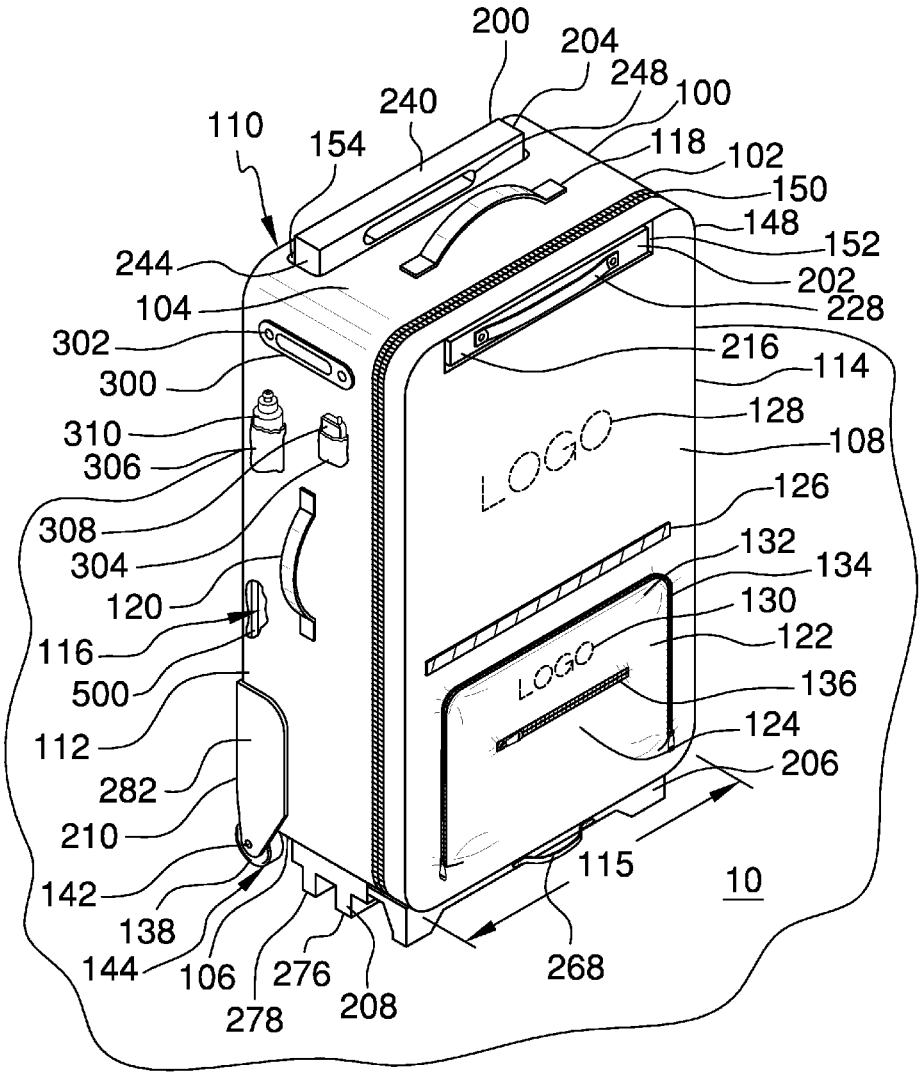
FIG. 1 is an isometric front perspective view of a luggage system 100.
Figure 2:
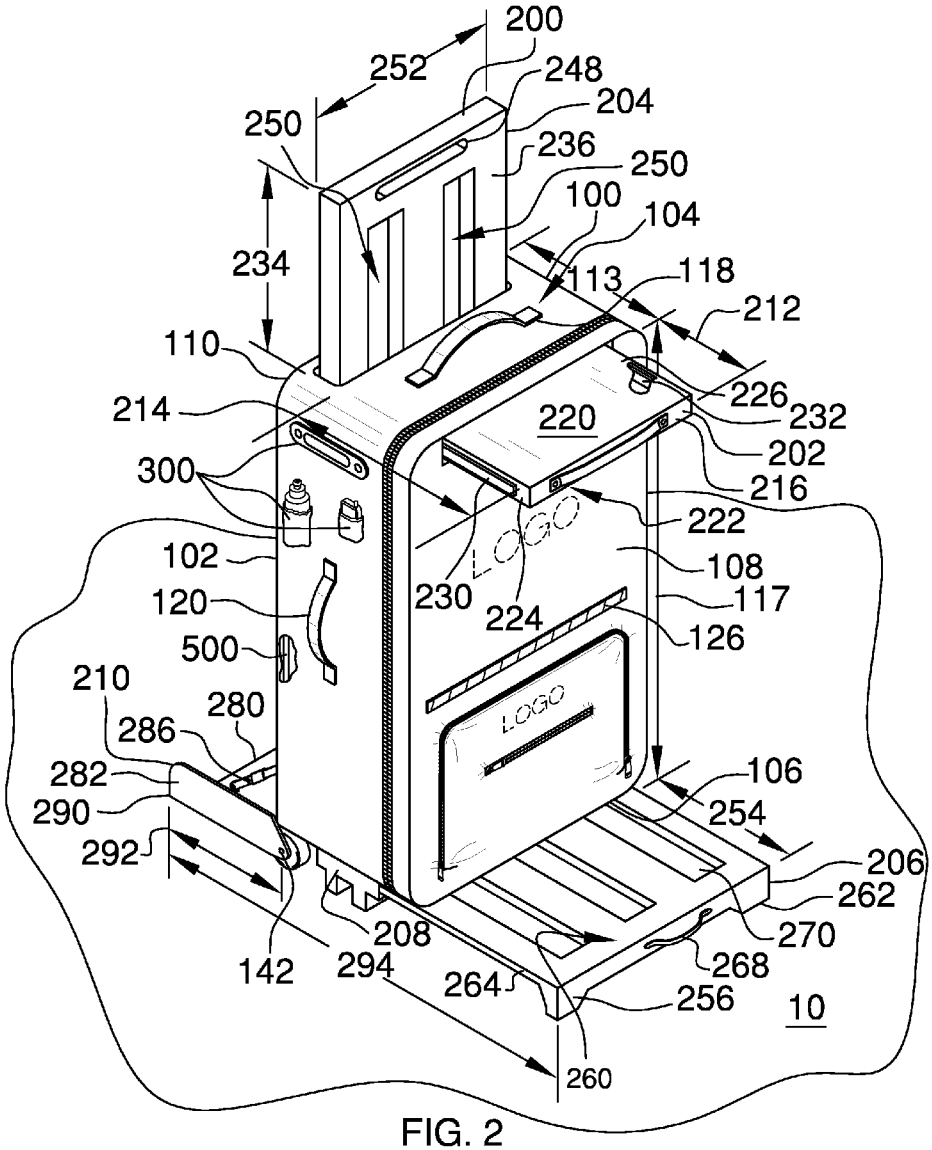
FIG. 2 is an isometric front perspective view of luggage system 100 with features of seat system 200 extended and features of entertainment center 300.

FIG. 1 is an isometric front perspective view of a luggage system 100. Luggage system 100 may be rolling luggage that includes a seat system 200, an entertainment center 300, a frame 500 (FIG. 5), and an organization system 600 (FIG. 6). FIG. 2 is an isometric front perspective view of luggage system 100 with features of seat system 200 extended and features of entertainment center 300. A traveler may utilize seat system 200 and entertainment center 300 to receive convenience and comfort while traveling with luggage system 100. Frame 500 may be arranged to provide structural support to seat system 200 and organization system 600 may allow a traveler to arrange and store their clothes and other travel item within luggage system 100.

In particular, luggage system 100 may include a seat upon which the traveler may rest to allow the user to relax while in line or when waiting in busy, crowded airports or bus or train stations where seats may not be available. While luggage system 100 may be of use to anyone who travels for business or pleasure, luggage system 100 may be of particular appeal to the elderly, to parents with young children especially infants, and to individuals with various physical disabilities that may make it difficult to stand or walk for lengths of time. The luggage system especially may be appreciated in light of the increased security at airports since the terrorists' attacks of Sep. 11, 2001, which has resulted in long lines and a substantial amount of time spent to ensure travelers' safety. In addition, entertainment center 300 may give additional convenience and comfort to users by allowing them to listen to music and have easy access to soothing items, such as a water bottle or their cell phone. Thus, luggage system 100 may fulfill a need for a suitcase that may provide added comfort while traveling, especially while waiting in various lines.

Luggage system 100 may include a container 102 having a container top 104 and a container bottom 106 positioned between a container front 108, a container back 110, a container left side 112, and a container right side 114, the collective of which may surround a container interior 116. Container interior 116 may be a hollow space within container 102.

Container 102 may have a general rectangular shape with rounded corners, where surfaces of container 102 may utilize vinyl, nylon, leather, or other material to fit around frame 500 and surround container interior 116. Container 102 may be defined by a container length 113 (FIG. 2) as measured between container front 108 and container back 110, a container width 115 (FIG. 1) as measured between container left side 112 and container right side 114, and a container height 117 (FIG. 2) as measured between container top 104 and container bottom 106. In one example, a ratio of container length 113 to container width 115 to container height 117 may be 9:16:22.

Luggage system 100 additionally may include an upper hand strap 118, a left side handle strap 120, a right side handle strap 121 (FIG. 3), a front pouch 122, a front pocket 124, a reflective strip 126, a first logo 128, and a second logo 130. Upper hand strap 118 may be connected to container top 104, left side handle strap 120 may be connected to container left side 112, front pouch 122, reflective strip 126, and first logo 128 each may be connected to container front 108 while front pocket 124 and second logo 130 each may be connected to front pouch 122. Reflective strip 126 may be positioned between first logo 128 and front pouch 122.

Upper hand strap 118, left side handle strap 120, and right side handle strap 121 each may be elongated strips of vinyl, nylon, or leather configured to allow a person to grab onto it. Each may be configured to be held to allow a traveler to lift or move travel system 100 by hand. In one example, each end of upper hand strap 118 may be secured to container top 104 with thread arranged in a cross-stitch pattern.

Front pouch 122 may be a small or medium size container to hold things for carrying. While front pouch 122 may be closed with a drawstring, front pouch 122 preferably may include a front pouch cover 132 that may be closed with front pouch zip fastener 134. Front pouch cover 132 may be a covering that runs along container front 108 to form a front pouch interior. Front pouch zip fastener 134 may be a slide fastener that utilizes a sliding tab to lock together two toothed edges.

Front pocket 124 may be a small bag to hold small and important items. Front pocket 124 may be attached to front pouch cover 132 and include a front pocket zip fastener 136. Front pocket zip fastener 136 may be a restraint to close an opening into front pocket 124. In one example, front pocket zip fastener 126 may include two rows of teeth closed into each other by moving a slider along their length and opened again by moving the slider in the other direction.

Reflective strip 126 may be a length of material having a surface that may be capable of physically reflecting light or sound waves. When reflected by reflective strip 126, the returning light waves or sound waves may provide identification and safety for any nighttime or low-light usage of luggage system 100. Reflective strip 126 may include adhesive or allow thread to pass there through to be sewn onto container front 320. Bright and reflective, reflective strip 126 may include microscopic glass beads to allow it to bounce back at least one thousand, four hundred times more light than white fabric, and retain half of its reflectivity at an extreme angle of forty degrees from the light source.

First logo 128 and second logo 130 each may be a symbol that acts to identify a company, an institution, or other entity. In one example, first logo 128 may form a commercial brand for luggage system 100. Second logo 130 may be positioned between front pouch zip fastener 134 and front pocket zip fastener 136.

Luggage system 100 additionally may include a left wheel 138 (FIG. 1), a right wheel 140 (FIG. 3), and an axle 142. Axle 142 may be connected to container 102 and connected between left wheel 138 and right wheel 140. Left wheel 138 and right wheel 140 each may be a circular device that is capable of rotating on axle 142 to facilitate transportation of container 102 and a remainder of luggage system 100. At a bottom most, remote radius of each of left wheel 138 and right wheel 140 respectively, left wheel 138 may include a left wheel bottom 144 (FIG. 4) that is configured to rest upon a ground 10 and right wheel 140 may include a right wheel bottom 146 (FIG. 4) that is configured to rest upon ground 10. Ground 10 may be any surface upon which luggage system 100 may roll. Axle 142 may be a central shaft to serve as a common axis of rotation for left wheel 138 and right wheel 140. Axle 142 may be positioned remote from and parallel to container back 110.

Luggage system 100 further may include a door 148, a door zip fastener 150, a seat extension slot 152, and a backrest slot 154. Door zip fastener 150 may connect door 148 to a remainder of container 102. Seat extension slot 152 may be positioned through container front 108 and backrest slot 154 may be positioned through container top 104.

Door 148 may be a swinging barrier to close an opening to container interior 116. Door 148 may include all of container front 108 and extend around to include part of container top 104, container bottom 106, container left side 112, and container right side 114.

Door zip fastener 150 may be a restraint to secure door 148 to a remainder of container 102. In one example, door zip fastener 150 may include two rows of teeth closed into each other by moving a slider along their length and opened again by moving the slider in the other direction. Door zip fastener 150 may extend substantially around door 148.

Seat extension slot 152 may be a vertically orientated opening through container front 108 that may contact container top 104. Backrest slot 154 may be a horizontally orientated opening through container top 104 that may be positioned adjacent to container back 110. In one example, seat extension slot 152 and backrest slot 154 may be rectangular in shape. The vertical and horizontal orientation of each slot may be relative to ground 10 when luggage system 100 is positioned in an upright position as in FIG. 1.

As noted above, luggage system 100 may include seat system 200. Seat system 200 may be an arrangement of parts to allow a user of luggage system 100 to take and maintain a seated position while being supported by a stable platform. In particular, luggage system 100 may allow a user to have their torso erect and supported from behind, their legs bent with the body supported on the buttocks, and their feet horizontal and supported from underneath. Additional features of luggage system 100 may be positioned to provide stabilizing support to container 102 to help ensure that the user does not topple from their seated position. Since luggage system 100 allows a traveler to assume such a safe rest position, luggage system 100 may contribute to that person's overall comfort and help make the travel experience more enjoyable.

Seat system 200 may include a seat extension 202, a backrest 204, a support feet 206, a support feet housing 208, and a support plate 210. Seat extension 202 may be moveably positioned horizontally within container interior 116 adjacent to container top 104 and be configured to pass through seat extension slot 152 to extend perpendicularly away from container front 108. Backrest 204 may be moveably positioned vertically within container interior 116 adjacent to container back 110 and be configured to pass through backrest slot 154 to extend perpendicularly away from seat extension 202. Support feet 206 may touch ground 10, be moveably positioned within support feet housing 208, and be configured to extend horizontally away from container front 108. Support plate 210 may be attached to axle 142 and be configured to rotate from a vertical position against container back 110 to engage ground 10 in a horizontal position.

Seat extension 202 may be a flat, rigid rectangular support that may be pulled horizontally out from container interior 116 to provide a length addition to the support surface defined by container length 113. When fully extended from container 102, seat extension 202 may provide an additional seat extension length 212 (FIG. 2) to container length 113 to give an overall seat length 214. Seat extension 202 may be made from reinforced titanium and include a seat extension front 216 and a seat extension rear 218 (FIG. 5), positioned between a seat extension top 220 (FIG. 2), a seat extension bottom 222, a seat extension left side 224, and a seat extension right side 226. Seat extension length 212 may be measured between container front 108 and seat extension front 216, where seat extension front 216 may be a vertically orientated surface parallel to container front 108. When used, seat extension 202 may support the hamstring area of the human legs when the buttock is positioned on container top 104. In one example, seat extension length 212 may be eight inches and, when the slider seat extension 202 is extended fully, overall seat length 214 may measure seventeen inches long and container width 115 may measure sixteen inches wide.

Seat extension 202 may include a seat extension handle strap 228 attached to seat extension front 216. Seat extension handle strap 228 may be elongated strip of flexible material configured to allow a person to grab onto it with their hand. Here, seat extension handle strap 228 may be configured to be held to allow a traveler to pull seat extension 202 by hand to slide seat extension 202 out from container interior 116 through seat extension slot 152.

Seat extension 202 may be supported by frame 500, a left seat extension bar 230, and a right seat extension bar 232. Left seat extension bar 230 may be attached between frame 500 and seat extension left side 224. Right seat extension bar 232 may be attached between frame 500 and seat extension right side 226. When seat extension 202 is in a closed positions as in FIG. 1, both left seat extension bar 230 and right seat extension bar 232 may be positioned completely within container interior 116 to, for example, prevent left seat extension bar 230 or right seat extension bar 232 from snagging a persons clothing. Left seat extension bar 230 and right seat extension bar 232 may be configured to move with seat extension 202 to guide and support seat extension 202 such as by telescoping with the movement of seat extension 202.

Figure 3:
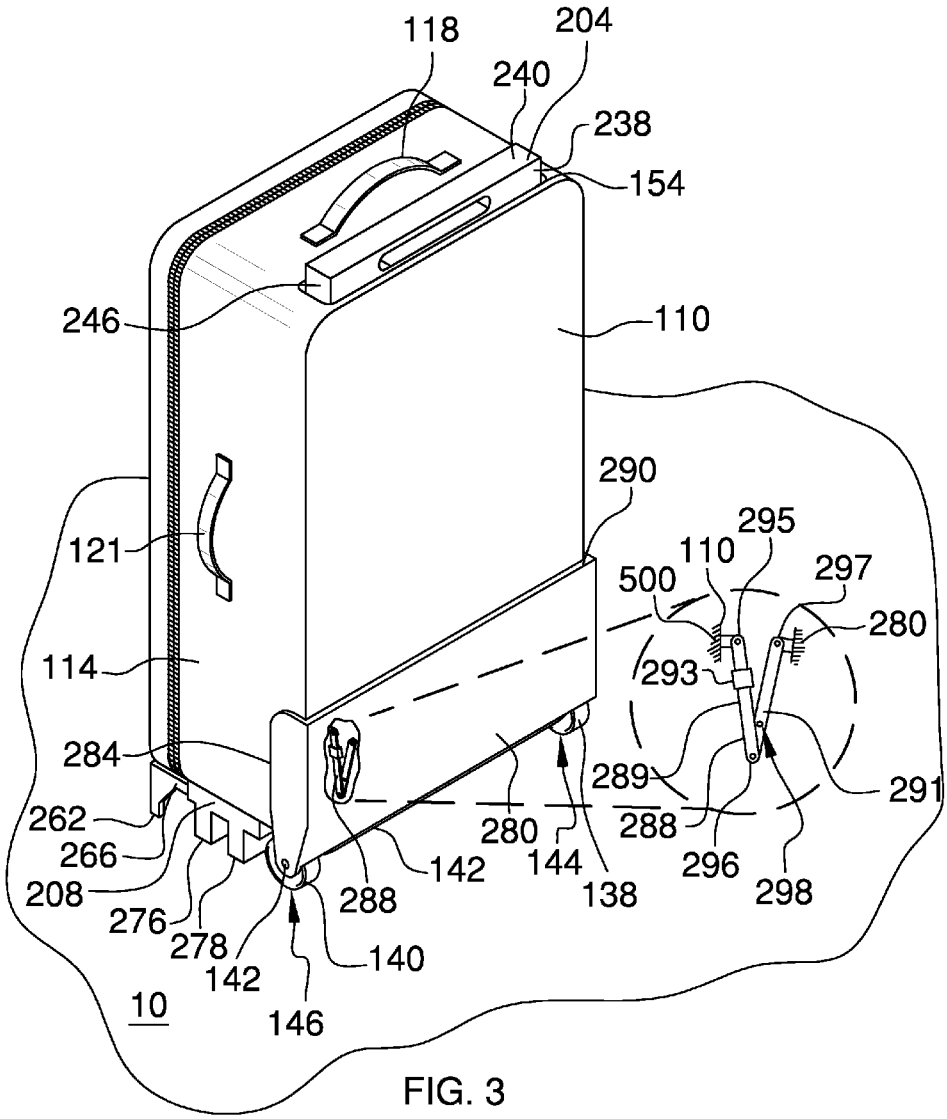
FIG. 3 is a detailed view of right hinge 288 in a somewhat closed position.

Backrest 204 may be a flat, semi-rigid rectangular support that may be pulled up and out from container interior 116 to a backrest height 234 (FIG. 2) when fully extended from container 102. Backrest 204 may include a backrest front 236 and a backrest rear 238 (FIG. 3), positioned between a backrest top 240, a backrest bottom 242 (FIG. 5), a backrest left side 244, and a backrest right side 246 (FIG. 3). Backrest height 234 may be measured between container top 104 and backrest top 240, where backrest top 240 may be a horizontally orientated surface parallel to container top 104. When extended and used, backrest 204 may support the lumbar area of the human torso when the buttocks is positioned on container top 104.

Backrest 204 may include a backrest handle 248 attached to backrest front 216 and additionally include elongated slots 250. Backrest handle 248 may be elongated opening through backrest 204 passing from backrest front 236 to backrest rear 238 and positioned adjacent to backrest top 240 to allow a person to grab onto it with their hand. Here, backrest handle 248 may be configured to be held to allow a traveler to pull backrest 204 by hand to slide backrest 204 up and out from container interior 116 through backrest slot 154. When backrest 204 is in a closed position as in FIG. 1, backrest handle 248 may reside above container top 104. Left wheel 138, right wheel 140, and telescopic handle 248 may allow for effortless transportation of luggage system 100.

Elongated slots 250 may be elongated vertical passages through backrest 204 passing from backrest front 236 to backrest rear 238. As material removed from backrest 204, elongated slots 250 may provided some horizontal bend to backrest 204 as a person leans against backrest 204. Backrest 204 may be supported by frame 500 and a releasable locking mechanism such as a ball and detent system to allow backrest 204 to be pulled out of and pushed back into container interior 116. Backrest 204 may have a backrest width 252 (FIG. 2) that substantially may be equal to a width of seat extension 202 as measured between seat extension left side 224 and seat extension right side 226.

Support feet 206 may be a rigid rectangular support positioned below container 102 that may be pulled horizontally out from support feet housing 208 to a support feet length 254 (FIG. 2) to reside directly below an extended seat extension 202. When fully extended away from container 102, support feet 206 may provide a place upon which a person may rest their feet while seated on container top 104 and seat extension 202. Support feet 206 may include a support feet front 256 (FIG. 2) and a support feet rear 258 (FIG. 4), positioned between a support feet top 260, a support feet bottom 262, a support feet left side 264, and a support feet right side 266 (FIG. 3). Support feet bottom 262 may reside in a same plane as left wheel bottom 144 and right wheel bottom 146 such that each contacts ground 10 when luggage system 100 is positioned vertically.

Support feet length 252 may be measured between container front 108 and support feet front 256, where support feet front 256 may be a vertically orientated surface parallel to container front 108 and to seat extension front 216. When fully extended and used, support feet 206 may support the feet and lower legs of a person when the buttocks is positioned on container top 104. In one example, support feet length 254 may be greater than seat extension length 212.

Support feet 206 may include a support feet handle strap 268 attached to support feet front 256 and include elongated slots 270. Support feet handle strap 268 may be an elongated strip of flexible material configured to allow a person to grab onto it with their hand. Support feet handle strap 268 may be held in a traveler's hand to allow that traveler to pull support feet 206 and extend support feet 206 horizontally away from support feet housing 208. When support feet 204 is in a closed position as in FIG. 1, support feet handle 248 may reside behind container front 108 to prevent support feet handle 248 from snagging on something.

Elongated slots 270 may be elongated vertical passages passing vertically through support feet 206. As material removed from support feet 204, elongated slots 270 may provided some vertical bend to support feet 204 as a person rests their feet on top of support feet 206. Support feet 204 may be supported by support feet housing 208 and ground 10. Support feet 204 may have a support feet width 272 (FIG. 5) that may be greater than a width of seat extension 202 and backrest width 252.

Support feet housing 208 may be an enclosure attached to container bottom 106 to receive and hold up support feet 206. Support feet housing 208 may include a support feet housing interior 274 (FIG. 5), a first support feet housing rib 276, and a second support feet housing rib 278. Support feet housing interior 274 may be a hollow area within support feet housing 208 to receive support feet 206. First support feet housing rib 276 and second support feet housing rib 278 each may be elongated projections that contact ground 10 in the same plane as left wheel bottom 144, right wheel bottom 146, and support feet bottom 262 when luggage system 100 is positioned vertically.

Support plate 210 may be a sheet of metal, plastic, or material configured to be pivotally rotate down to ground 10 to help stabilize container 102 when a person is sitting on container 102. With support plate 210 rotated to contact ground 10 and support feet 206 fully extended out from support feet housing 208 as in FIG. 2, container 102 may be stabilized to receive a traveler seated on container top 104 and an extended seat extension 202. This arrangement may provide support to prevent the seated traveler from toppling forward or backward.

Support plate 210 may include a support plate base 280 (FIG. 2) positioned between a support plate left flap 282 and a support plate right flap 284 (FIG. 3), each of which may extend perpendicularly away from support plate base 280. Support plate left flap 282 and support plate right flap 284 may be connected to axle 142 to provide pivot points for support plate 210. Support plate 210 additionally may include a left hinge 286 (FIG. 2) and a right hinge 288 (FIG. 3), each connected between frame 500 and support plate base 280 to retain support plate 210 against container back 110 and to lock support plate 210 against ground 10. Support plate 210 may include a support plate front 290 at a most remote distance from axle 142.

Support plate base 280 may be a flat, rectangular shape foundation for support plate 210. As a lowest support of the structure of support plate 210, support plate base 280 may be parallel to and come into contact with container back 110 when support plate 210 is in a stowed position (FIG. 1) and may be parallel to and come into flush contact with ground 10 when support plate 210 is in a fully rotated/extended position (FIG. 2).

Support plate left flap 282 and support plate right flap 284 may be flat sides of support plate 210 that provide structural rigidity to support plate base 280. Support plate left flap 282 may be at a distance from support plate right flap 284 to allow support plate 210 to surround three sides of container 102 when support plate 210 is in a stowed position. In one example, support plate left flap 282 and support plate right flap 284 may be positioned apart from each other at a distance that may be greater than container width 115 to allow support plate 210 to surround container 102.

Support plate 210 may have a support plate length 292 (FIG. 2) as measured from axle 142 to support plate front 290. In one example, support plate length 292 may equal one of support feet length 254 and container height 117. Luggage system 100 may include a stabilizing support length 294 (FIG. 2) as measured between support feet front 256 and support plate front 290 when support plate 210 is rotated to contact ground 10 and support feet 206 is fully extended out from support feet housing 208 as in FIG. 2. In one example, a ratio of stabilizing support length 294 to container height 117 substantially may be one to one.

As noted above, support plate 210 additionally may include left hinge 286 (FIG. 2) and right hinge 288 (FIG. 3). Left hinge 286 and right hinge 288 each may be connected between frame 500 and support plate base 280 to retain support plate 210 against container back 110 and to lock support plate 210 against ground 10. Left hinge 286 may have a configuration similar to right hinge 288.

FIG. 3 is a detailed view of right hinge 288 in a somewhat closed position. In comparison, FIG. 2 shows left hinge 286 in a fully open and locked position. Right hinge 288 (FIG. 3) may include a first link 289, a second link 291, and a lock 293. First link 289 may be attached to frame 500 through container back 110 adjacent to a first pivot 295. Second link 291 may be attached to first link 289 at a second pivot 296 and may be attached to support plate base 280 adjacent to a third pivot 297. Second link 291 may include a lock support 298. Lock support 298 may be material extending perpendicularly away from second link 291 and may be positioned to position lock 293 around second pivot 296 and to prevent lock 293 from sliding down second link 291. Lock 293 may be positioned about first link 289 and configured to slide relative to first link 291 and second link 291.

While support plate 210 is rotated about axle 142 towards container back 110 and towards a closed position, first link 289, second link 291, and lock 293 may be configured to pivot and/or move towards container back 110. While support plate 210 is rotated about axle 142 towards ground 10 and towards an open position, first link 289 and second link 291 may be brought in straight alignment. Lock 293 may be moved down first link 289 and then down second link 291 to contact lock support 298. With lock 293 resting against lock support 298, lock 293 may cover second pivot 296 to prevent first link 289 and second link 291 from rotating relative to each other about second pivot 296. This may rigidly secure support plate 210 in an open position against ground 10. With support plate 210 secured in an open position, support feet 206, support feet housing 208, and support plate 210 may work together to support container 102 in an upright, vertical position while a person sits on container 102.

As noted above, luggage system 100 may include entertainment center 300. Entertainment center 300 (FIG. 1) may add to the comfort and enjoyment of a traveler utilizing luggage system 100 as a seat. Entertainment center 300 may include a sound system 302, a side case 304, and a side pouch 306. Sound system 302 may be attached to frame 500 through container left side 112 at a position adjacent to container top 104. Side case 304 and side pouch 306 each may be attached to container left side 112 between sound system 302 and left side handle strap 120.

Sound system 302 may be a system of electronic equipment to record and reproducing sound. Sound system 302 may include a jack to receive a headphone connection. In one example, sound system 302 may be a FM radio. In another example, sound system 302 may include one or more of a television set, a DVD player, an MP3 player, an AM/FM tuner, and a multi-disc compact disc changer. Side case 304 may be a container configured to carry a mobile phone 308. Side pouch 306 may be a container configured to carry a water bottle 310. Mobile phone 308 may be a rectangular-shape portable telephone that may connect with a telephone network over radio wave transmission. Water bottle 310 may be a round-shaped container to hold water.

Figure 4:
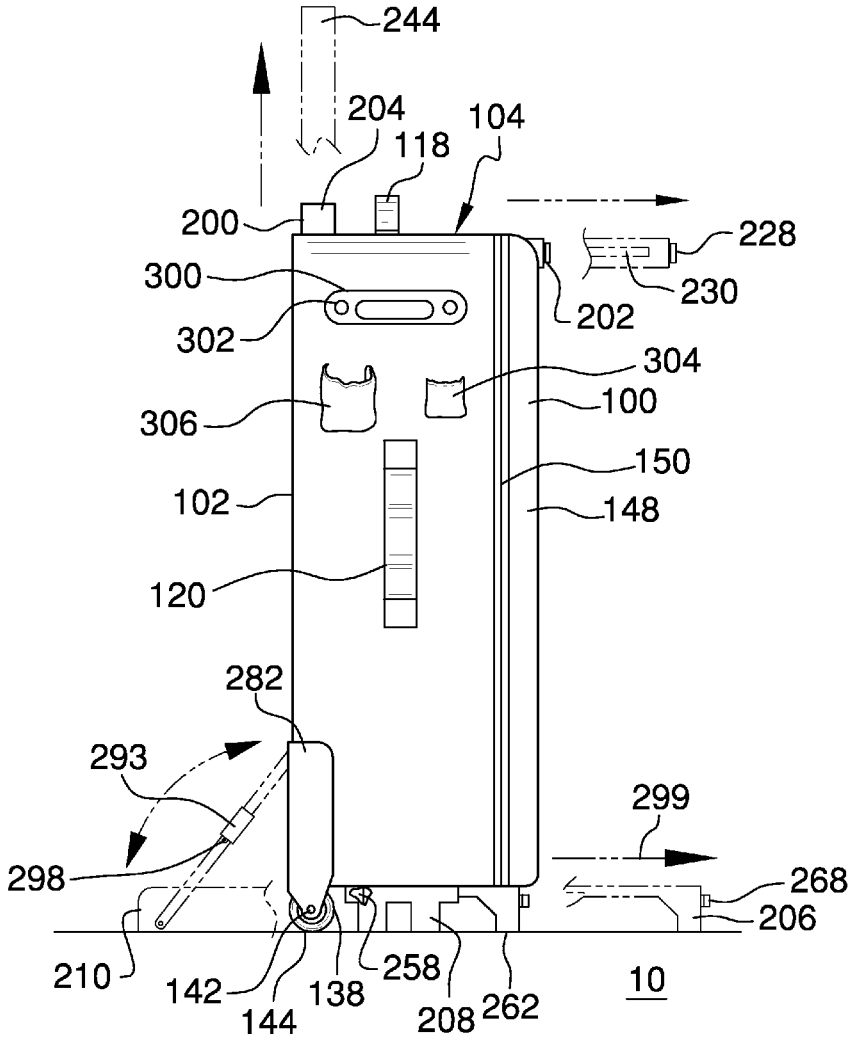
FIG. 4 is a side view of luggage system 100 illustrating movement of components of seat system 200.

FIG. 4 is a side view of luggage system 100 illustrating movement of components of seat system 200. To arrange luggage system 100 to receive a seated person, support plate 210 may be rotated down from its position around container 102 to contact ground 10. Lock 293 may be slid down to contact lock support 298 so that lock 293 covers second pivot 296. Support feet 206 may be pulled from support feet housing 208 in a direction of arrow 299 until fully extended. With support plate 210 and support feet 206 fixed in place against ground 10, backrest 204 may be pulled vertically upward until fully extended and seat extension 202 may be pulled horizontally until fully extended. With components of seat system 200 thus arranged, a traveler may sit both on container top 104 and seat extension 202 with their back against backrest 204 and feet resting on support feet 206. Both support feet 206 and support plate 210 may serve to prevent container 102 from toppling forward or backwards. A seated person may turn on sound system 302, grab their mobile phone 308 (FIG. 3) from side case 304, and grab their water bottle 310 (FIG. 3) from side pouch 306 to increase their comfort and enjoyment.

Figure 5:
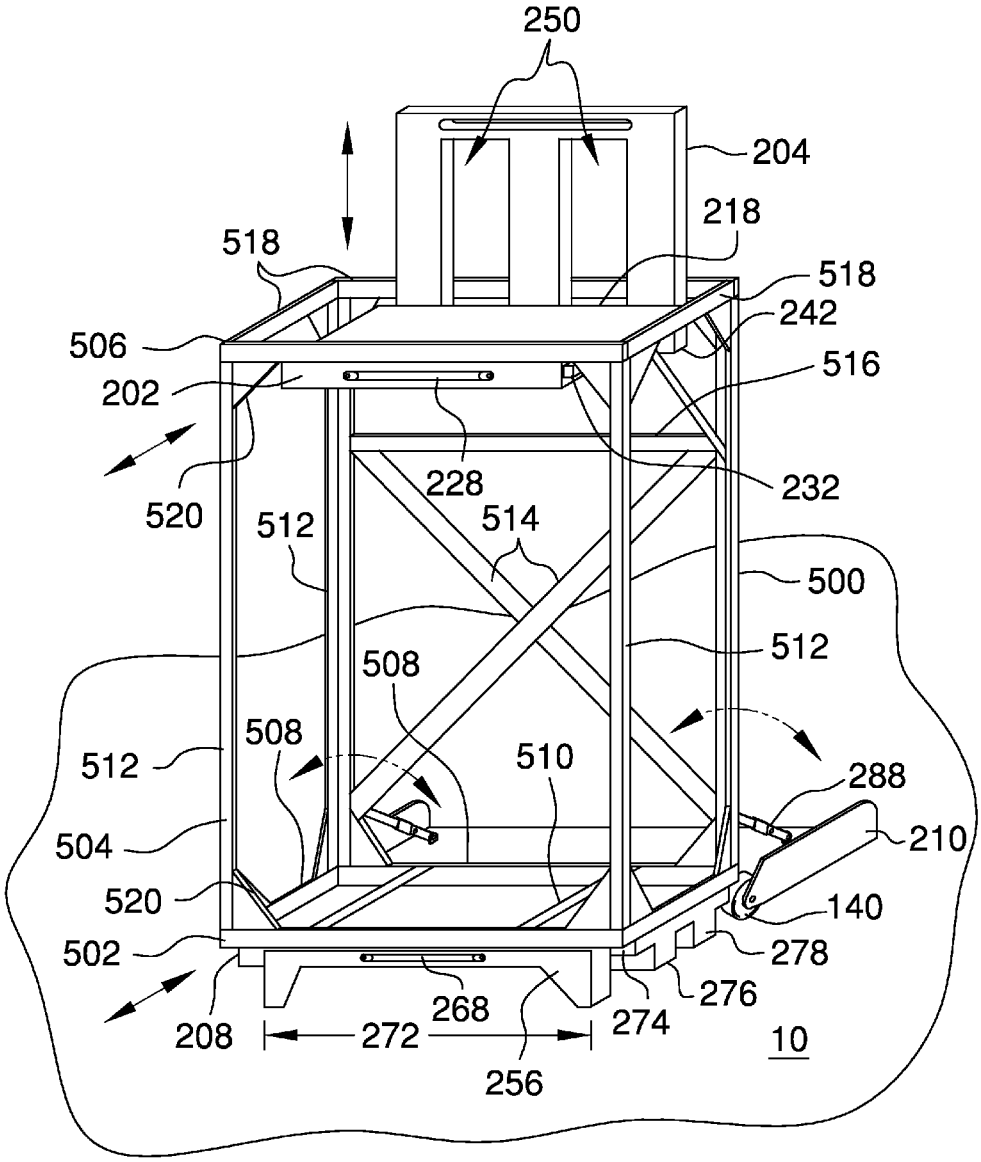
FIG. 5 is an isometric front view of frame 500.
Figure 6:
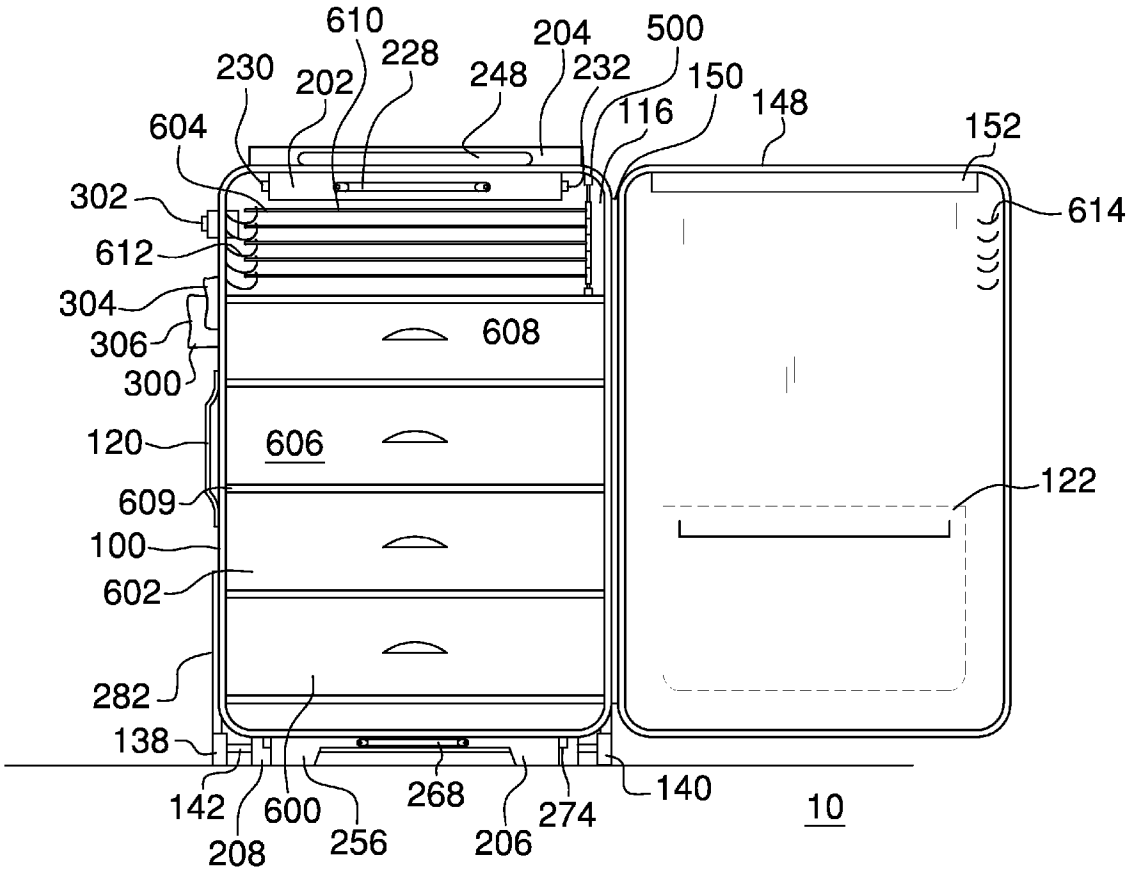
FIG. 6 is a front elevated view of luggage system 100 having door 148 open to reveal organization system 600 positioned within container interior 116.

FIG. 5 is an isometric front view of frame 500. Frame 500 may be a supporting structure internal to container 102 that gives container 102 its rectangular shape. Frame 500 may include a frame base 502, a frame body 504, a frame top 506, and other members. Frame body 504 may be connected between frame base 502 and frame top 506, where frame bottom 502 may be a lower portion of frame 500.

Frame base 502 may be a lowest support of frame 500 and may be made from four frame base members 508 connected at right angles to form a rectangular shape having four corners. Frame base 502 may be parallel to ground 10. Each of the four frame base members 508 may have a square or round cross section. Support feet housing 208 may be connected to frame base 502. Frame base 502 additionally may include two ribs 510 extending between two parallel frame base members 508.

Frame body 504 may be a support that elevates frame top 506 up and away from frame base 502. Frame body 504 may include four vertical members 512, where each vertical member 512 may be connected to a corner of frame base 502 to project upward and away from ground 10. In one example, each vertical member 512 may be an upright post. Frame body 504 additionally may include two diagonal members 514 that may connect between two vertical members 512 to reside oblique to frame base 502 and to cross one another. For additional support, a girt member 516 may extend between upper ends of two diagonal members 514 as a horizontal structural member of frame 500. Support plate 210 may be connected to frame base 502 and frame body 504.

Frame top 506 may be an uppermost support of frame 500 and may be made from four frame top members 518 connected at right angles to form a rectangular shape having four corners. Frame top 506 may be parallel to ground 10 and to frame base 502. Each of the four frame top members 518 may have a square or round cross section. Each vertical member 512 may be connected to a corner of frame top 506 to project downward and away from frame top 506. Support feet housing 208 may be connected to frame top 506.

As noted above, seat extension 202 may be supported by frame 500. Here, left seat extension bar 230 may be attached between frame top 506 and seat extension left side 224. Right seat extension bar 232 may be attached between frame top 506 and seat extension right side 226. Backrest 204 may be supported by frame body 504 and frame top 506.

Frame 500 additionally may include a plurality of gussets 520. Each gusset 520 may be a rigid bar connected at an angle between two perpendicularly connected components to reinforce the connection between those two components. In one example, two gussets 520 may extend between frame body 504 and frame top 506 to connect substantially at one location along a vertical member 512. In another example, at least one gusset 520 may be a rigid triangle plate connected between two perpendicularly connected components to reinforce the connection between those two components.

FIG. 6 is a front elevated view of luggage system 100 having door 148 open to reveal organization system 600 positioned within container interior 116. Organization system 600 may include a drawer system 602 and a pant hanging system 604. Drawer system 602 may be connected to frame 500 and pant hanging system 604 may be connected to frame 500 above drawer system 602 and below seat extension 202.

Drawer system 602 may be an integrated drawer system and may include drawers 606, where each drawer 606 may be a boxlike container in container 102 made to slide in and out. Each drawer 606 may include a drawer handle 608. Each drawer 606 may be made of lightweight material such as other than fabric, and rest on sliding mechanisms 609 to slide in and out. In one example, there may be four drawers 606 that may be stacked one on top of another.

Pant hanging system 604 may work to keep pants stored in luggage system 100 free from wrinkles so that the pants retain their professional look. Pant hanging system 604 may include rods 610 positioned parallel to support feet housing 208 and to one another. Each rod 610 may be a slender bar configured to receive one pair of pants and be pivotally mounted on one side to rotate out of and into container interior 116 to swivel for ease of access. Each rod 610 may be built in a folding seem of frame 500 adjacent to folding cover (front flap) 148 of luggage system 100.

When rotated into container interior 116, each rod 610 may be secured by a container rod hook 612. When rotated out of container interior 116, each rod 610 may be secured against door 148 by a door rod hook 614. Each container rod hook 612 and door rod hook 614 may be a latch or other device to secure a rod 610 in place.

The luggage system may be a modified article of luggage that may incorporate a seat upon which the traveler may rest. The system may allow a user to relax while in line or when waiting in busy, crowded airports or bus or train stations where seats may not be available. While the luggage system may be of use to anyone who travels for business or pleasure, it may be of particular appeal to the elderly, parents with young children especially infants, and individuals with various physical disabilities that may make it difficult to stand or walk for lengths of time. The luggage system especially may be appreciated in light of the increased security at airports since the terrorists' attacks of Sep. 11, 2001, which has resulted in long lines and a substantial amount of time spent to ensure travelers' safety.

The wheeled, carry-on suitcase may consist of a rectangular unit featuring a titanium rod frame with the exterior produced of vinyl, nylon, leather, or other material. This article of luggage may contain wheels and a telescopic handle through which it may be effortlessly transported. The luggage system may include an integrated seat upon the top of the suitcase. More specifically, a rectangular section of reinforced titanium may provide the seat that also may be employed as a table or work surface for placement of a laptop computer. A slider seat may extend an additional eight inches from the front of the suitcase to provide added comfort. It may easily be extended through the inclusion of a front handle. Supports for the extension may rest to the sides of the slider. When the slider is fully extended, the seat area may measure seventeen inches long by sixteen inches wide. For enhanced stability while seated upon the luggage system, foldout feet may extend from the front of the suitcase, while extended supports may be hinged and fold out from the rear of the luggage. Extending from the top of the luggage system may be a backrest that may be pulled easily upward for use and ease in maneuvering the luggage or for back support when seated. It may be possible to produce this suitcase in various colors with an array of decorative designs. In addition, it may be produced in economy and deluxe versions. A version of the luggage system may measure nine inches long by sixteen inches wide, with a height of twenty-two inches.

In addition to providing a practical seat, various other features may provide added convenience and comfort for travelers. Positioned within the side of the suitcase may be a pouch for storing a water bottle as well as a case in which a cell phone may be stored in a readily accessible fashion. Furthermore, the luggage system may include an MP3 or other digital audio encoding format player as well as a radio. These battery-powered electronics may be incorporated within one side of the suitcase.

The luggage system may fulfill a need for a suitcase that may provide added comfort while traveling, especially while waiting in various lines. The appealing features of the luggage system may be its convenience, practicality, and reasonable price. The luggage system may incorporate a seat that may allow the traveler to relax while waiting in line, for a flight or train, or a taxi. Thus, the luggage system may ensure the individual always had a seat available and did not have to rest upon a dirty floor or the ground. This may be of particular appeal to the elderly and anyone with a physical limitation who cannot walk or stand for long lengths of time. However, in light of the horrific events that occurred on Sep. 11, 2001, the luggage system may be of use to all travelers as they may be spending a great deal of time in lines due to increased security measures which involve not only the carry-on luggage being thoroughly checked but also the traveler, his shoes, all luggage entering the plane, etc. The luggage system may eliminate travelers from attempting to rest upon the top of standard carry-on suitcases that may lead to embarrassment and possibly an injury.

The luggage system may eliminate the need to leave one's luggage unattended, which may result in it being stolen or damaged. It also may contain an MP3 player and radio through which the traveler may listen to music while en route to his/her destination. The luggage system may incorporate a practical side pouch and case in which a water bottle and cell phone may be housed conveniently to ensure they may be readily accessible. The top surface may be versatile, in that, in addition to providing a seat, it also may provide a surface upon which the traveler may eat or place a laptop computer. In addition, the inclusion of the extending feet may allow the luggage system to be employed as a dolly for transporting other items such as additional suitcases. The luggage system may allow the traveler to enjoy his/her business or pleasure trip more thoroughly.

The luggage system additionally may include an integrated drawer system and pant hanging rods built into and on the frame. The rods may swivel to provide ease of access. The drawers may be made of lightweight material, not fabric, and rest on sliding mechanisms. The pant hanging rods may be built in the folding seem of the frame adjacent to the folding cover of the luggage (front flap). The pant hanging rod give the pants stored in the luggage a free from wrinkle and professional look and care for garments stored.

When traveling through an airport, the majority of the airports typically do not provide sitting arrangements for passengers forming an early line to their assigned boarding rows. Most travelers may start to form their line thirty to sixty minutes before boarding going through normal frustration. The luggage system may accommodate these travelers.

The luggage system may create a fast and easy convenient way to find a seat no matter where a person travels. Being made of a lightweight material, the carry-on can be handled with ease. The luggage system may have 22"×16"×9" dimensions, a tabletop built into the luggage, an integrated MP3, FM & AM radio built on side of carry-on, a side carrying pouch for water bottle holder and cell phone case, a titanium Frame to provide light weight durability and strength built in the luggage, fold out footings to support luggage and additional usage in sitting mode or table top mode and can be used as a type of mini dolly to carry and support other types of luggage. A wheel mechanism may be under and integrated into fold out footings to provide ease of mobility. The luggage system may provide seating availability, may be durable and lightweight, include a reinforced titanium frame, and may include titanium-footing foldouts for superior support. Reinforced titanium metal may be used for the tabletop and telescoping wide back support may be used in chair mode and mini dolly mode. The luggage system may be used as a tabletop for laptops and other electronics. The strong durable construction may be multifunctional.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A travel assisting luggage system to carry articles and otherwise assist a person while traveling with the luggage system, the luggage system comprising:

a frame;

a container connected around the frame, the container having a container top and a container bottom positioned between a container front, a container back, a container left side, and a container right side, the collective of which surrounds a container interior, where the container includes door zip fastener that connects a door to a remainder of the container and includes a seat extension slot positioned through container front and a backrest slot positioned through the container top;

an axle connected to the frame at a position that is adjacent to the container bottom and the container back, where the axle is connected between a left wheel and a right wheel;

an entertainment center attached to a container side, where the entertainment system includes a sound system, a side case, and a side pouch;

a seat system connected to the frame, where the seat system includes a seat extension moveably positioned horizontally within the container interior to pass through the seat extension slot when extended perpendicularly away from the container front, where the seat system includes a backrest moveably positioned vertically within the container interior to pass through the backrest slot when extended perpendicularly away from the seat extension, where the seat system includes support feet moveably positioned within a support feet housing connected to the container bottom to extend horizontally away from the container front, and where the seat system includes a support plate attached to the axle to rotate from a vertical position against the container back to engage a ground; and an organization system positioned within the container interior and attached to the frame.

2. The luggage system of claim 1, further comprising:

an upper hand strap connected to the container top;

a side handle strap connected to the container left side; and a front pouch, a reflective strip, and a first logo as a symbol that conveys a company identity, each connected to the container front, and a front pocket and a second logo connected to the front pouch, where the reflective strip includes a surface that is capable of physically reflecting light and is positioned between the first logo and the front pouch.

3. The luggage system of claim 1, where the seat extension slot is a vertically orientated opening through the container front that contacts the container top and where the backrest slot is a horizontally orientated opening through the container top that is positioned adjacent to the container back.

4. The luggage system of claim 3, where the seat extension is moveably supported by a left seat extension bar attached to the frame and a right seat extension bar attached to the frame to allow the seat extension to move relative to the frame by telescoping with the movement of seat extension.

5. The luggage system of claim 4, where a width of the backrest is equal to a width of the seat extension.

6. The luggage system of claim 4, where the support feet is configure to extend away from the container to a support feet length that both is greater than a seat extension length of the seat extension and is configured to receive the feet of a person whose hamstring area is residing on the seat extension.

7. The luggage system of claim 1, where the support plate includes a support plate base positioned between a support plate left flap and a support plate right flap, each of which project perpendicularly away from the support plate base and each of which are connected to the axle to provide pivot points for the support plate, where the support further includes a left hinge and a right hinge, each connected between the frame and the support plate base and configured to retain the support plate against the container back and to lock the support plate against the ground.

8. The luggage system of claim 7, where the right hinge includes a first link attached to the frame through the container back at a first pivot, where the right hinge includes a second link attached to the first link at a second pivot and attached to the support plate base at a third pivot, where the right hinge further includes a lock support attached to and extending away from the second link and includes a lock that is moveably positioned about the first link and configured to slide relative to the first link and the second link to come into contact with the lock support to fix the first link to the second link.

9. The luggage system of claim 8, where the sound system is attached to the frame through the container left side at a position adjacent to the container top and the side case and the side pouch are attached to the container left side between the sound system and a side handle, where the sound system is a system of electronic equipment to record and reproducing sound.

10. The luggage system of claim 9, where the organization system includes a drawer system 602 connected to the frame and having drawers and a pant hanging system connected to the frame above the drawer system.

11. The luggage system of claim 10, where the drawer system comprises four drawers stacked one on top of another.

12. The luggage system of claim 10, where the pant hanging system includes rods positioned parallel an upper surface of a drawer and to one another, where each rod is pivotally mounted on one side to rotate out of and into the container interior, and where the pant hanging system includes container rod hook attached to the container to engage and secure the rods and includes door rod hook attached to the door to engage and secure the rods.

* * * * *